US005126018A

United States Patent [19]

Stutts et al.

[11] Patent Number: 5,126,018

[45] Date of Patent: Jun. 30, 1992

[54] METHOD OF PRODUCING SODIUM DITHIONITE BY ELECTROCHEMICAL MEANS

[75] Inventors: Kenneth J. Stutts; Mou S. Chao, both of Midland, Mich.; Ramanathan Gopal; Indresh Mathur, both of Sarnia, Canada

[73] Assignee: The Dow Chemical Company, Midland, Mich.

[21] Appl. No.: 668,388

[22] Filed: Mar. 13, 1991

Related U.S. Application Data

[63] Continuation of Ser. No. 431,494, Nov. 3, 1989, abandoned, which is a continuation-in-part of Ser. No. 222,447, Jul. 21, 1988, abandoned.

[51] Int. Cl.[5] ..... C25B 1/14; C25B 1/28

[52] U.S. Cl. ..... 204/92; 204/82; 204/294

[58] Field of Search ..... 204/82, 92, 294

[56] References Cited

U.S. PATENT DOCUMENTS

| | | | |
|---|---|---|---|
| 2,216,605 | 10/1940 | Skalarew et al. | 204/DIG. 2 |
| 2,273,799 | 2/1942 | Janes et al. | 204/92 |
| 3,385,780 | 5/1968 | Feng | 204/294 |
| 3,523,069 | 8/1970 | Oloman | 204/92 |
| 3,905,879 | 9/1975 | Eng | 204/92 |
| 3,920,551 | 11/1975 | Cook et al. | 204/92 |
| 3,985,674 | 10/1976 | Ellis et al. | 252/188 |
| 4,118,305 | 10/1978 | Oloman et al. | 204/265 |
| 4,144,146 | 3/1979 | Leutner et al. | 204/92 |
| 4,236,993 | 12/1980 | Muller et al | 204/294 |
| 4,326,938 | 4/1982 | Das Gupta et al. | 204/294 |
| 4,534,954 | 8/1985 | Little et al. | 423/515 |
| 4,740,287 | 4/1988 | Cawlfield | 204/256 |
| 4,743,350 | 5/1988 | Clawfield et al. | 204/255 |
| 4,761,216 | 8/1988 | Cawlfield | 204/284 |
| 4,786,380 | 11/1988 | van Duin et al. | 204/294 |
| 4,793,906 | 12/1988 | Bolick et al. | 204/92 |

FOREIGN PATENT DOCUMENTS

| | | | |
|---|---|---|---|
| 475059 | 11/1937 | United Kingdom | 204/92 |

*Primary Examiner*—T. Tung

[57] ABSTRACT

A method of producing sodium dithionite comprising electrolyzing a catholyte solution of sulfur dioxide in an electrolytic cell at a pH of at least about 3, the electrolytic cell having a carbonaceous cathode, is disclosed. Particularly high current efficiencies can be attained using a high surface area carbon material for the cathode. The use of a stabilizer to inhibit decomposition of the sodium dithionite to form sodium thiosulfate is also disclosed. The stabilizer is added to the catholyte and is selected from the group consisting of phosphoric acid, sodium tripolyphosphate, acid phosphates and mixtures thereof.

7 Claims, No Drawings

METHOD OF PRODUCING SODIUM DITHIONITE BY ELECTROCHEMICAL MEANS

CROSS-REFERENCE TO RELATED APPLICATION

This is a continuation of application Ser. No. 07/431,494, filed Nov. 3, 1989, now abandoned, which application is a Continuation-in-Part of application Ser. No. 07/222,447 filed Jul. 21, 1988, now abandoned.

FIELD OF THE INVENTION

The present invention relates to a method of producing sodium dithionite. More particularly, the present invention relates to a method of producing sodium dithionite by electrochemical means.

BACKGROUND OF THE INVENTION

Sodium dithionite is the strongest sulfur-based reducing agent known. It has a number of industrial uses, including the "bleaching" of textiles, paper and clay. Syntheses of this chemical have been known since the 19th century and include electrolytic means. The electrolytic methods generally involve the reduction of bisulfite ($HSO_3-$) to produce either zinc dithionite or sodium dithionite, and can be done using cells of various kinds. These cells are in some cases compartmented and employ electrodes of various materials. For example, U.S. Pat. No. 4,144,146 discloses a process for the production of dithionite by cathodic reduction of an aqueous solution in a compartmented cell using a cathode made of a noble metal, electrically conductive noble metal oxide, silver, chromium, stainless steel, or any of various other metals and alloys. The use of a graphite cathode in a compartmented cell having a cation-active permselective membrane is mentioned in U.S. Pat. Nos. 3,920,551 and 3,905,879, but is considered undesirable for a variety of reasons, including mechanical instability.

A problem encountered in electrolytic dithionite production is the decomposition of the product. In general the zinc dithionite is more stable than the sodium dithionite with respect to anaerobic decomposition. However, zinc dithionite is seldom used now because of environmental concerns. In contrast, sodium dithionite decomposes easily. This decomposition can take place both aerobically and anaerobically. The aerobic mechanism involves the diffusion-controlled reaction of oxygen with dithionite. Sodium dithionite ($Na_2S_2O_4$) decomposes by this pathway to ultimately form sodium sulfate ($Na_2SO_4$). Anaerobic decomposition involves the reaction of the dithionite to form sodium bisulfite ($NaHSO_3$) and sodium thiosulfate ($Na_2S_2O_3$) via a disproportionation mechanism. Sodium thiosulfate formed by the anaerobic decomposition of sodium dithionite is an undesirable product in many cases. This is because it is very corrosive to metals in general, and even to some stainless steel. This corrosiveness presents particular problems in paper mills because it damages suction rolls and head boxes used in paper manufacturing.

In order to reduce the problems resulting when sodium dithionite decomposes to form sodium thiosulfate, the sodium dithionite is often sold in solid form. In this form it generally has a maximum purity of about 85 percent and must be dissolved in order to be useful for many processes. However, the dissolution is often performed some distance from the use site, which may allow the undesirable decomposition to occur during transport. To counter this it is alternatively possible to prepare a dithionite from aqueous sodium borohydride ($NaBH_4$) on-site. The sodium borohydride solution is mixed with $NaHSO_3$, which has been prepared by first reacting $SO_2$ with NaOH. The advantage of this is that the on-site preparation reduces the time during which decomposition can take place.

Another method of reducing the decomposition of sodium dithionite to sodium thiosulfate is to use an additive, such as a chelating agent or buffer, in the sodium dithionite product. This is commonly done in paper manufacturing processes during the pulp bleaching process. Commonly used additives include, for example, ethylenediaminetetraacetic acid (EDTA), diethylenetriaminepentaacetic acid (DTPA), propylene oxide, zinc sulfate, oxalic acid, formaldehyde and formic acid. See. e.g., U.S. Pat. Nos. 3,672,829 and 3,669,895. It is alternatively possible to add sodium formate to the sodium dithionite, as disclosed in U.S. Pat. No. 4,622,216. In general these additives do not prevent all decomposition; however, because of the additives the total sodium thiosulfate/sodium dithionite ratio is less than it would be otherwise. Another method of inhibiting decomposition is disclosed in U.S. Pat. No. 3,773,679, involving the introduction of sodium sulfite or an analogue, preferably with a pH adjustment. to the sodium dithionite product under aerobic or anaerobic conditions. Mixtures of sodium sulfite or sodium bicarbonate with sodium bisulfite are also noted to be effective. In all cases the additives are introduced into the sodium dithionite product at some point following its production.

Thus, because of the undesirability of decomposition a method of producing sodium dithionite that can be carried out on-site production immediately prior to use is desired. Such a method would preferably result in a sodium dithionite product having an acceptable sodium thiosulfate/sodium dithionite ratio.

SUMMARY OF THE INVENTION

The present invention provides a method of producing sodium dithionite comprising electrolyzing a catholyte solution of sulfur dioxide in an electrolytic cell at a pH of greater than about 3, the electrolytic cell having a carbonaceous electrode.

The present invention further provides a method of producing sodium dithionite comprising electrolyzing a catholyte solution comprising sulfur dioxide in an electrolytic cell under reaction conditions sufficient to form sodium dithionite, the catholyte further comprising a stabilizer in an amount such that decomposition of the sodium dithionite is reduced.

DESCRIPTION OF THE PREFERRED EMBODIMENTS

The process of the present invention can produce aqueous sodium dithionite streams suitable for use in bleaching various materials, such as pulp, textiles, or clay from sulfur dioxide feedstock. In general, the process involves using an electrochemical cell having a carbonaceous cathode and a sulfur dioxide-containing catholyte having a pH of at least about 3. In a preferred embodiment the process further involves using an anode preferably selected from any conducting, corrosion resistant material and a separator between the anode and the cathode.

In the process of the present invention the nature of the cathode is important. It is preferred that the cathode have a high hydrogen overpotential such that it is capable of high current efficiency for the proposed reaction. Furthermore, a high surface area cathode is preferred since utilization of high current densities is preferred for economic reasons. A carbonaceous material is used as the cathode. These carbon-containing materials can preferably be selected from the group consisting of carbon-felt, carbon paste, reticulated vitreous carbon, highly abraded carbon plate, plasma-etched carbon, and other high surface area carbons. Carbon-containing alloys and compound materials can also be used, such as boron carbide, tungsten carbide, silicon carbide, carbon/polytetrafluoroethylene alloys, and so forth.

The anode can preferably be selected from the group consisting of nickel, titanium, cadium, ruthenium-coated titanium, stainless steel, and carbon. If stainless steel is chosen it is preferred that it be of an electropolished type. Other anode materials that are corrosion resistant in the environment of the anolyte can also be used.

In the process of the present invention the catholyte is a solution of sulfur dioxide. Compounds forming sulfur dioxide in solution include, for example, gaseous sulfur dioxide, sodium sulfite, sodium bisulfite and mixtures thereof. Other compounds can be added to the catholyte to adjust the pH thereof. For example, sodium hydroxide and other alkali metal hydroxides such as potassium hydroxide, carbonates and bicarbonates can preferably be added to the catholyte feed to raise the pH to the desired level. This desired level is at least about 3, preferably from about 3 to about 7, and more preferably from about 4.5 to about 5.5.

The anolyte preferred in the present invention is one that allows the application of a current through the cell at a low voltage. The anolyte can preferably be selected from the group consisting of solutions of various alkali metal hydroxides such as sodium hydroxide and potassium hydroxide, sodium bicarbonate, sodium chloride, sodium sulfate, sodium carbonate and mixtures thereof. Of these, sodium hydroxide is preferred.

In one preferred embodiment of the present invention an electrochemical cell having separate anode and cathode compartments is preferably used. These compartments are preferably separated by a membrane which has the selectivity to allow cations to pass therethrough, but which is impermeable to anions. This type of membrane is commonly referred to as a cation-exchange membrane. Non-selective separators such as diaphragms or other types of membranes can also be used. A membrane made of perfluorosulfonic acid is preferred.

In another embodiment of the present invention a stabilizer is preferably added to the catholyte feed solution. The stabilizer serves to reduce the formation of sodium thiosulfate and thus reduces the potential corrosiveness of the final product. Preferred as stabilizers are phosphate ion-containing compounds, including phosphoric acid, sodium tripolyphosphate, various acid phosphates including dihydrogenphosphates and monohydrogenphosphates, and mixtures thereof: phosphoric acid, sodium tripolyphosphate (STPP) and mixtures thereof are more preferred: and phosphoric acid is most preferred. The amount of the stabilizer may vary depending on the stabilizer choice. For example, from about 5 to about 10 g/l of phosphoric acid; from about 5 to about 20 g/l of sodium tripolyphosphate; and about 5 g/l of dihydrogenphosphate can preferably be used. It is preferred that sufficient stabilizer be employed to improve the current densities to greater than 1 A/in$^2$ and assure a sodium thiosulfate/sodium dithionite weight/weight ratio of less than about 0.05. This ratio is more preferably less than about 0.04,and most preferably less than about 0.02. The stabilizer thus improves the overall efficiency of the cell. For example, without stabilizer, at 1 A/in$^2$ the sodium thiosulfate/sodium dithionite weight/weight ratio is in the vicinity of about 0.024. In contrast, with the stabilizer added to the catholyte feed solution the ratio is reduced to about 0.01. It is preferred that a current density of at least about 0.25/A/in$^2$ be attained. A current efficiency of at least about 50 percent is also preferred.

OPERATION

In one embodiment of the present invention, the cell described above has a carbon-felt cathode and uses an anolyte consisting of a NaOH solution which can be recycled. The catholyte consists of gaseous sulfur dioxide dissolved into sodium hydroxide to create a sulfur dioxide solution having a pH of at least about 3. and preferably from about 3 to about 7. Phosphoric acid is added to the catholyte feed as a stabilizer. The concentration of the anolyte is preferably optimized to yield the lowest cell voltage and is generally greater than about 0.5 M. A membrane made of perfluorosulfonic acid separates the anode compartment from the cathode compartment.

The catholyte is recycled through the cathode compartment during electrolysis and is kept under nitrogen or protected from aerobic decomposition in an analogous manner. The catholyte flow rate is controlled by a pump. It is preferred to use a high flow rate above about 25 cathode compartment volumes per minute. It is also preferred that the residence time of the product in the catholyte recirculation loop is as short as possible in order to discourage decomposition. A constant current is generally applied through the cell.

It is preferred to maintain the catholyte pH in a specific range. Since decomposition of dithionite is rapid at a low pH, it is preferred to maintain a pH of at least about 3, more preferred that it be from about 3 to about 7, and still more preferred that it be from about 4.0 to about 6.5. It is most preferred that it be from about 4.5 to about 5.5 for the optimum yield in reducting bisulfite to dithionite.

The temperature at which the given reaction and process can be carried out is preferably from about 0° C. to about 30° C. Lower temperatures within and beyond this range tend to reduce the decomposition rate of dithionite, while the higher temperatures generally facilitate operation at lower cell voltages: thus, a balance between these two advantages is desirable. A more preferred temperature range is from about 10° C. to about 25° C.

The following examples are given to more fully illustrate the present invention and are not intended to limit the scope of the invention or the claims. Unless otherwise indicated, all parts and percentages are by weight.

EXAMPLE 1

A laboratory-scale electrolytic cell is fabricated from plexiglass with two halves. A TEFLON* (*TEFLON is a trademark of E.I. DuPont de Nemours Co.) gasket is used on each side of a perfluorosulfonic acid cation exchange membrane, which separates the anode compartment from the cathode compartment. Carbon-felt fills the cathode cavity and is contacted by a stainless steel plate. Electrolyte flow is accomplished by pumping the catholyte through an entrance port, then through the carbon-felt and out an exit port. The anode is a wide mesh of ruthenium on titanium for corrosion resistance.

A catholyte solution consisting of 0.25 M $NaHSO_3$ and 0.80 M $SO_2$ is fed into the cathode compartment and circulated at a rate of 300 ml/min through a reservoir. The anolyte is a 100 g/liter NaOH solution circulating at 60 ml/min. The product is taken out of the reservoir with a metering pump at a rate of 0.90 ml/min. A pH of about 5.7 is maintained in the reservoir by varying the catholyte input and the current. After about 200 minutes, a steady state is reached. The effluent is a solution of 4.50 percent $Na_2S_2O_4$, 0.25 percent $Na_2S_2O_3$, and 3.15 percent $NaHSO_3$. The current density is 1.24 A/in$^2$ at the cathode and the anode. The yield is calculated as about 54 percent and the current efficiency as 60.2 percent.

EXAMPLE 2

A solution consisting of 0.35 M $NaHSO_3$ and 1.02 M $SO_2$ is fed into the cathode compartment of the electrochemical cell described in Example 1. Other conditions are the same as shown in that example except that the pH is maintained at about 5.6. After about 200 minutes, the steady state effluent is 5.53 percent $Na_2S_2O_4$, 0.34 percent $Na_2S_2O_3$ and 5.72 percent $NaHSO_3$. The yield is calculated as 51.8 percent and the current efficiency as 54.4 percent. The current density is 1.69 A/in$^2$.

EXAMPLE 3

A solution of 0.3 M NaOH, 1.0 M $SO_2$, and about 10 g/l of sodium tripolyphosphate is prepared and circulated through the cathode compartment of an electrochemical cell as described in Example 1 except with a nickel anode. At the same time a solution of 100 g/l NaOH is circulated through the anode compartment. The catholyte flow rate is about 300 ml/min, and the same flow rate is maintained for the anolyte. The cell pH is controlled at about 5.5 by the addition of fresh NaOH/$SO_2$ aqueous solution. After about 100 minutes the steady state effluent is about 5.2 percent sodium dithionite and about 0.06 percent sodium thiosulfate. The current density is measured at 1.0 A/in$^2$, and the current efficiency is about 85 percent. The yield is calculated at about 63 percent. The weight/weight ratio of sodium thiosulfate/sodium dithionite in the product is measured as 0.011.

EXAMPLE 4

A comparative process done at the same pH as in Example 3, using the same catholyte solution except without any sodium tripolyphosphate, shows a higher sodium thiosulfate/sodium dithionite weight/weight ratio of 0.028. Current density is 1.0 A/in$^2$.

EXAMPLE 5

A solution of 0.3 M NaOH, 0.95 $SO_2$, and about 10 g/l of sodium tripolyphosphate is prepared and circulated through the cathode compartment of the electrochemical cell described in Example 1. At the same time a solution of 100 g/l NaOH is circulated through the anode compartment. The cell pH is about 5.0. The steady state effluent is about 5.4 percent sodium dithionite and about 0.075 percent sodium thiosulfate. The weight/weight ratio of sodium thiosulfate/sodium dithionite in the product is measured as 0.014. The current efficiency is about 81 percent at a current density of about 1.0 A/in$^2$ and the yield is calculated as about 64 percent.

EXAMPLE 6

A solution of 0.3 M NaOH and 1.0 M $SO_2$ is prepared as described in Example 4, except without any sodium tripolyphosphate, and circulated through the cathode compartment of the electrochemical cell as described in Example 1. At the same time a solution of 100 g/l NaOH is circulated through the anode compartment. The cell pH is about 5.0. The steady state effluent is about 5.8 percent sodium dithionite and about 0.15 percent sodium thiosulfate. The weight/weight ratio of sodium thiosulfate/sodium dithionite in the product is 0.026. The current efficiency is about 92 percent at a current density of about 1.0 A/in$^2$ and the yield is calculated as about 68 percent.

EXAMPLE 7

A solution of 0.4 M NaOH, 1.2 M $SO_2$, and 8 g/l of phosphoric acid is prepared and circulated through the cathode compartment of the electrochemical cell as described in Example 1. At the same time a solution of 100 g/l NaOH is circulated through the anode compartment. The cell pH is about 5.0. The steady state effluent is about 7.6 percent sodium dithionite and about 0.14 percent sodium thiosulfate. The weight/weight ratio of sodium thiosulfate/sodium dithionite in the product is measured as 0.018. The current efficiency is about 95 percent at a current density of about 1.0 A/in$^2$ and the yield is calculated as about 70 percent.

What is claimed is:

1. A method of producing sodium dithionite comprising electrolyzing a catholyte solution comprising sulfur dioxide in an electrolytic cell under reaction conditions sufficient to form sodium dithionite, the catholyte solution further comprising a stabilizer selected from phosphate ion-containing compounds and which is present in an amount sufficient to allow for cell operation at higher current densities while substantially reducing formation of sodium thiosulfate during electrolysis when compared to an otherwise similar method which does not employ the stabilizer.

2. The method of claim 1 wherein the stabilizer is selected from the group consisting of phosphoric acid, sodium tripolyphosphate, acid phosphates and mixtures thereof.

3. The method of claim 2 wherein the pH is from greater than about 3 to about 7.

4. The method of claim 3 wherein the electrolytic cell has a carbonaceous cathode

5. The method of claim 1 wherein the electrolytic cell is operated at a current density of greater than about 1 A/in$^2$ and the sodium dithionite is obtained from a product having a weight/weight ratio of sodium thiosulfate to sodium dithionite of less than about 0.05.

6. The method of claim 5 wherein the weight/weight ratio of sodium thiosulfate to sodium dithionite is less than about 0.02.

7. A method of producing sodium dithionite comprising electrolyzing a catholyte solution of sulfur dioxide in an electrolytic cell at a pH of from about 4.5 to about 5.5 under reaction conditions sufficient to form sodium dithionite, the catholyte further comprising a stabilizer such that decomposition of the sodium dithionite is reduced, the stabilizer being selected from the group consisting of phosphoric acid, sodium tripolyphosphate, acid phosphates, and mixtures thereof, the electrolytic cell having a carbonaceous cathode.

* * * * *